US008261397B2

(12) United States Patent
Lee

(10) Patent No.: US 8,261,397 B2
(45) Date of Patent: Sep. 11, 2012

(54) FLEXIBLE WIRE FOR REMOVING PIPE SCALE

(75) Inventor: Kwang Ho Lee, Seoul (KR)

(73) Assignee: E2ST Inc., Seoul (KR)

( * ) Notice: Subject to any disclaimer, the term of this patent is extended or adjusted under 35 U.S.C. 154(b) by 885 days.

(21) Appl. No.: 12/298,515

(22) PCT Filed: Apr. 20, 2007

(86) PCT No.: PCT/KR2007/001933

§ 371 (c)(1),
(2), (4) Date: Oct. 24, 2008

(87) PCT Pub. No.: WO2007/123335

PCT Pub. Date: Nov. 1, 2007

(65) Prior Publication Data

US 2010/0000035 A1 Jan. 7, 2010

(30) Foreign Application Priority Data

Apr. 24, 2006 (KR) ..... 10-2006-0036764
Mar. 30, 2007 (KR) ..... 10-2007-0031744

(51) Int. Cl.
*B08B 9/02* (2006.01)

(52) U.S. Cl. ..... 15/104.09; 15/104.33; 15/104.05; 254/134.3 CL

(58) Field of Classification Search ..... 15/57, 88, 15/90, 104.05, 104.09, 104.31, 104.095; 57/200; 428/371, 377; 52/712, 719, 856, 52/857; 254/134.3 CL, 134.3 FT, 134.3 SC; *E04C 3/00*

See application file for complete search history.

(56) References Cited

U.S. PATENT DOCUMENTS

| | | | | | |
|---|---|---|---|---|---|
| 1,020,672 | A | * | 3/1912 | Wilson | 254/134.3 FT |
| 2,466,083 | A | * | 4/1949 | Crosby | 24/129 B |
| 2,482,204 | A | * | 9/1949 | Peterson | 57/202 |
| 3,028,146 | A | * | 4/1962 | Sparks | 254/134.3 FT |
| 3,438,098 | A | * | 4/1969 | Grabner | 24/131 R |
| 3,440,694 | A | * | 4/1969 | Durbin | 403/399 |
| 3,457,580 | A | * | 7/1969 | Meyers | 15/104.33 |
| 3,858,653 | A | * | 1/1975 | Turbyfill | 166/173 |

(Continued)

FOREIGN PATENT DOCUMENTS

JP 2003149013 A * 5/2003

OTHER PUBLICATIONS

WIPO, International Search Report for International Application No. PCT/KR2007/001933.

*Primary Examiner* — Joseph J Hail
*Assistant Examiner* — Joel Crandall
(74) *Attorney, Agent, or Firm* — Intellectual Property Law Group LLP

(57) ABSTRACT

The present invention relates to a flexible wire (100), which is inserted in a pipe and rotated in a high speed to remove scale produced in a pipe by striking. A flexible wire (100) for removing pipe scales comprising: a main wire (110) having plural wires twisted in a spiral direction as one body, wherein the main wire (110) has an overall straight shape; and an auxiliary wire (120) having plural wires twisted in a spiral direction as one body, of which a diameter is substantially smaller than a diameter of the main wire (110), wherein the auxiliary wire (120) is secured to the main wire (110) and has an overall repeated S-shape.

5 Claims, 5 Drawing Sheets

U.S. PATENT DOCUMENTS 4,583,585 A * 4/1986 Estienne et al. ..... 165/94
4,781,245 A * 11/1988 Freychet et al. ..... 165/94
4,895,221 A * 1/1990 Carlson ..... 184/15.1
5,357,705 A * 10/1994 Stengel ..... 42/95
5,418,997 A * 5/1995 DeFrange ..... 15/104.31
5,987,684 A * 11/1999 Evans ..... 15/104.33
6,276,018 B1 * 8/2001 Leiman et al. ..... 15/104.19
6,421,871 B1 * 7/2002 Peach et al. ..... 15/104.33
7,052,554 B2 * 5/2006 Rothenberger ..... 134/6
7,234,669 B2 * 6/2007 Franks, Jr. ..... 248/63
7,269,874 B2 * 9/2007 Hung ..... 15/104.095
2004/0111948 A1 * 6/2004 Schnell ..... 42/95

* cited by examiner

[Fig. 1]
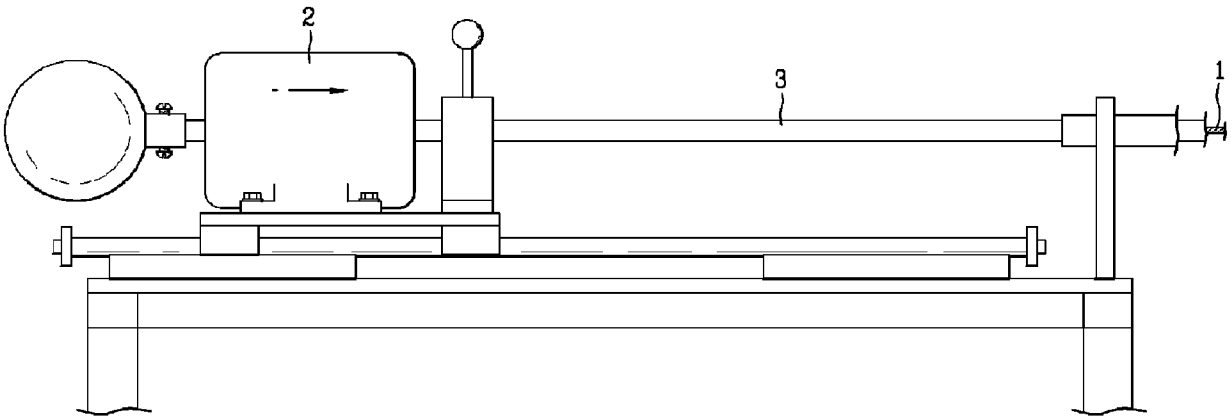
[Fig. 2]
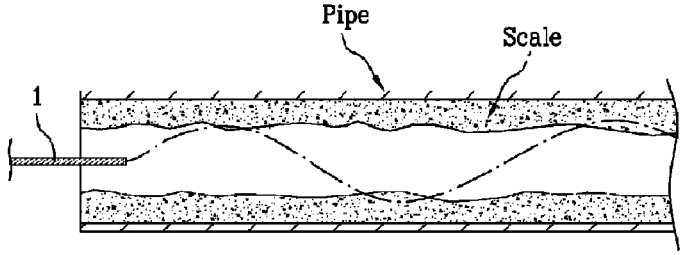

[Fig. 3]
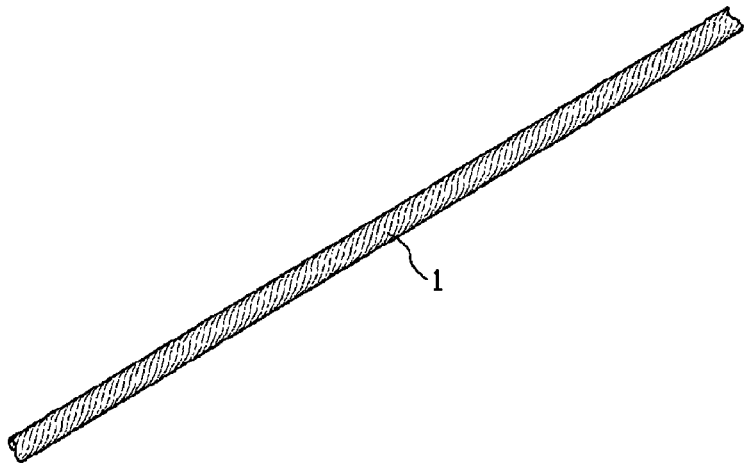
[Fig. 4]
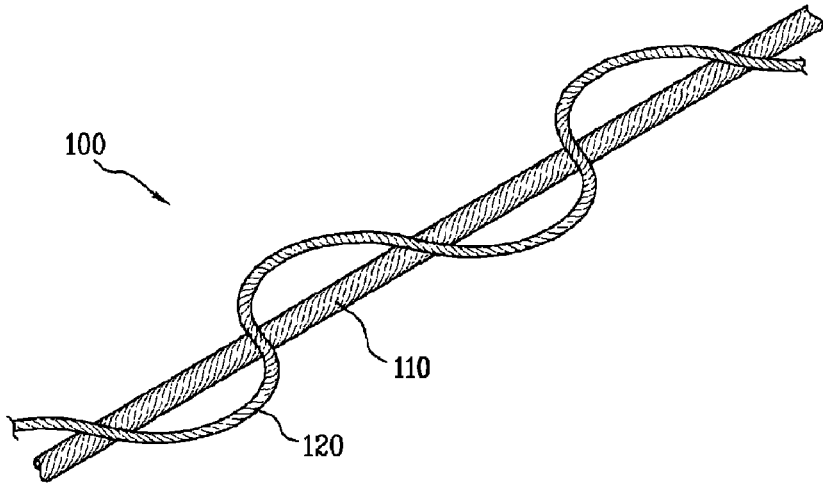
[Fig. 5]
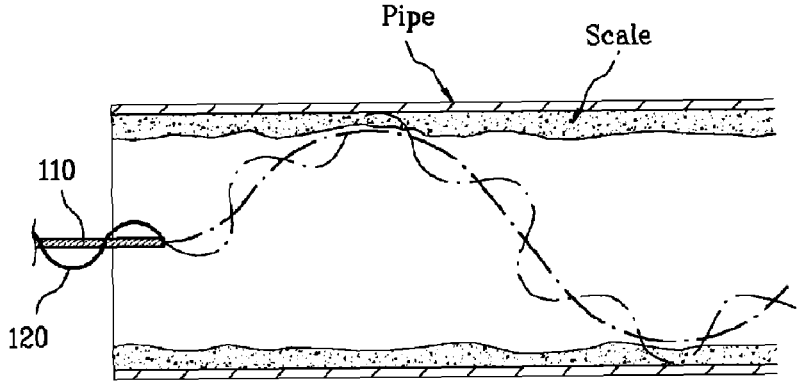

[Fig. 6]
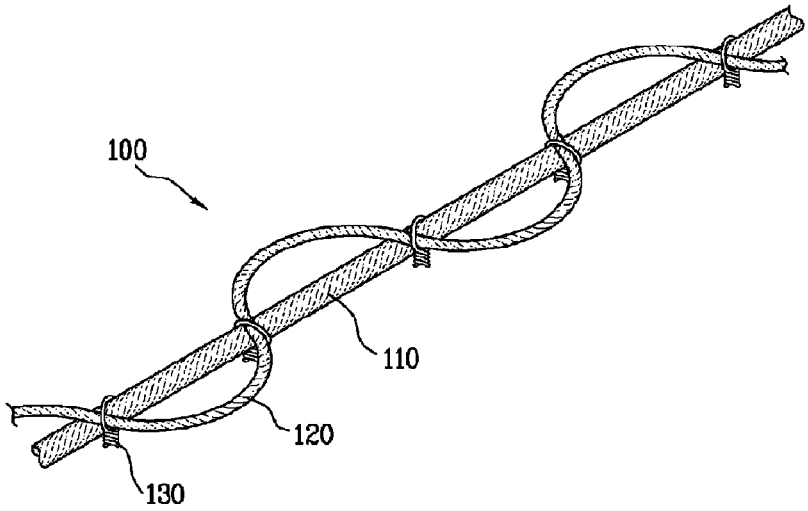
[Fig. 7]
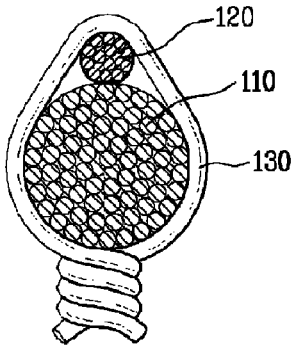
[Fig. 8]
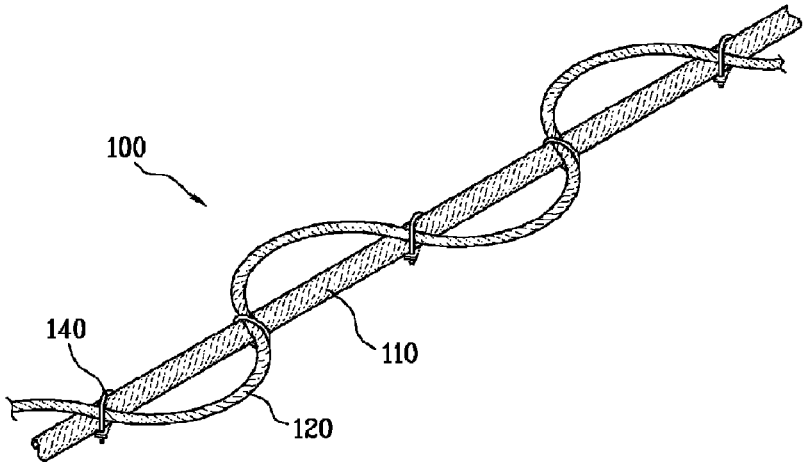

[Fig. 9]
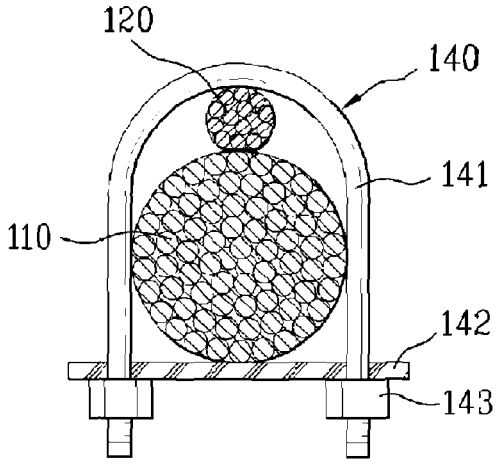
[Fig. 10]
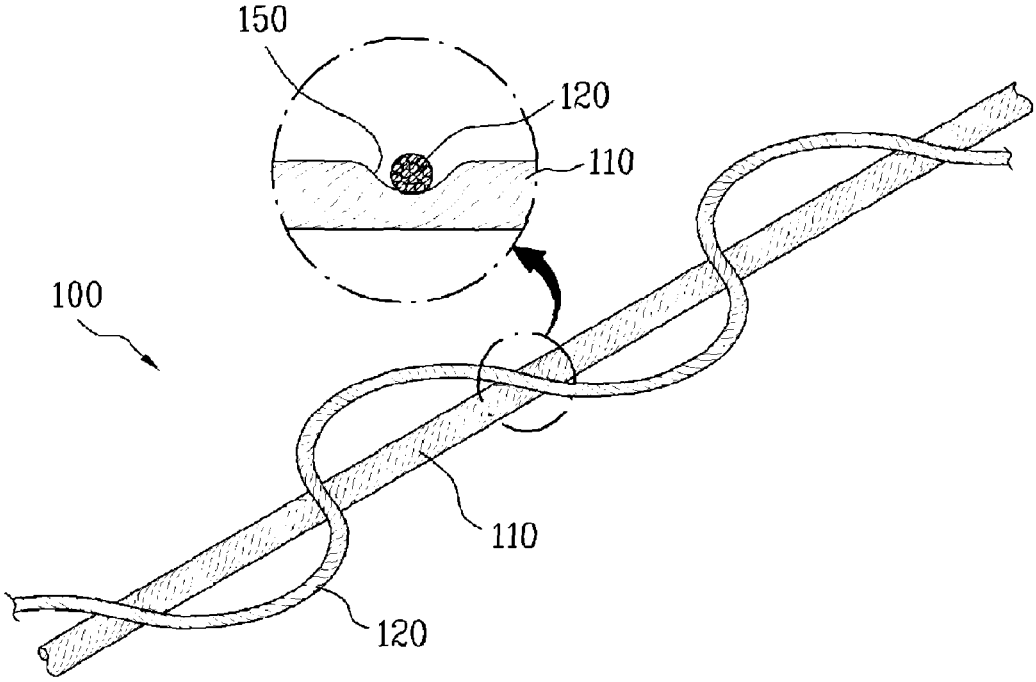

[Fig. 11]
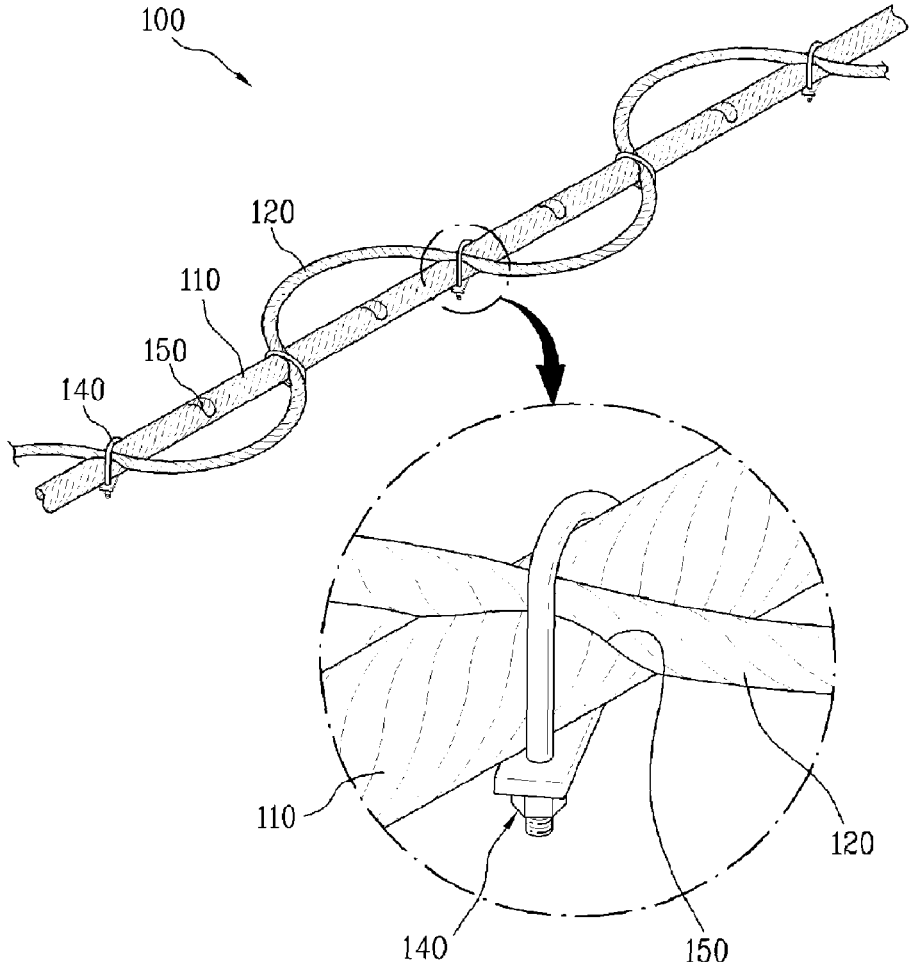
[Fig. 12]
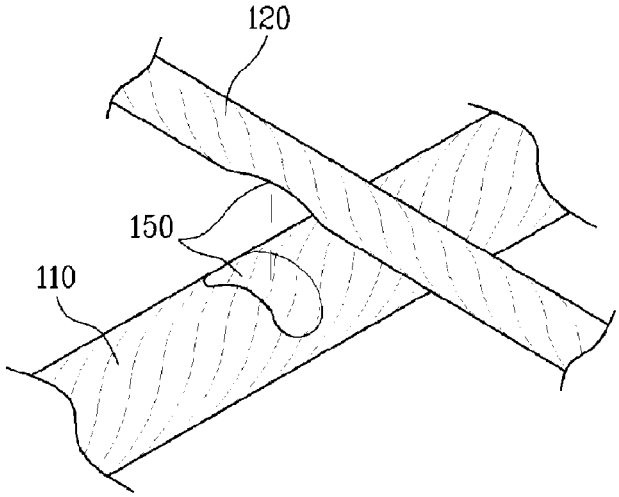

FLEXIBLE WIRE FOR REMOVING PIPE SCALE

TECHNICAL FIELD

The present invention relates to a flexible wire. More specifically, the present invention relates to a flexible wire, which is inserted in a pipe and rotated in a high speed to remove scale produced in a pipe by striking.

BACKGROUND ART

Pipes are generally passages through which liquids such as water or the other kinds are induced and moved. Pipes are typically embedded in floors or walls of buildings.

As such pipes are used for a relatively long time, acid eats inner surfaces of such pipes and various kinds of foreign substances are susceptible to being stuck on the inner surface and thus scales may be produced. The scales may be solidified as time passes and they are the cause for narrow diameter of a pipe passage.

Once a pipe passage gets narrow by scales, it is not smooth to move fluidal material through a pipe and thus the pipe may not be functioned as designed. Still worse, there might be damage to the pipe due to motion pressure of fluidal material. As a result, as soon as scales are produced in a pipe, scales should be removed to allow the pipe to be functioned normally.

A method has been broadly used to remove scales that water mixed with chemicals passes a pipe and the chemicals contacts with scales to cause chemical reaction. As a result, the scales dissolve in water by the chemical reaction.

However, an auxiliary mechanism such as an injection unit should be provided in the above method that uses chemicals. Also, this method should be taken good care of during the scale removing process, because chemicals are used. Thus, damage to pipes might be caused by chemicals during the scale removing process and cost for working the process may be relatively high, because chemicals cost quite a lot.

Furthermore, even though it is announced that such chemicals do no harm to humans, consumers who uses water may have anxiety. Especially, people who live in ordinary houses may be negative in using chemicals to remove scales. Accordingly, the problem caused by scales in pipes is not solved easily.

There are well-known pipe scale removing devices invented to solve above problems.

As shown in FIGS. 1 and 2, according to a conventional pipe scale removing device, a flexible wire is inserted in a pipe and the flexible wire is rotated at a high speed so that the rotating flexible wire repeatedly collides with scales produced in the pipe until the scales fall off.

More specifically, once a worker inserts the flexible wire 1 in a pipe and operates a motor 2 at a high speed, a driving force of the motor 2 is transmitted to the flexible wire 1 and the flexible wire 1 is rotated in a guide pipe 3. The rotational force makes the flexible wire 1 outside the guide pipe 3 to pitch and roll, such that the flexible wire 1 may strikes an inner surface of the pipe. Scales produced in the pipe may be fell off the inner surface of the pipe by the striking of the flexible wire 1 and the scales are removed.

Demands for such conventional pipe scale removing device may have been increased by people living in apartments and condominiums who are supplied drinking water through pipes, because no chemicals are used in such conventional pipe scale removing device.

However, as shown in FIG. 3, the flexible wire 1 adapted in the above pipe scale removing device that removes scales in a pipe by striking has several wires that are twisted in a spiral shape to be one body, such that above flexible wire 1 is an overall straight single main wire.

Accordingly, there may be a problem of such flexible wire in that it is difficult to remove scales in pipes having a long diameter, because the striking diameter of centrifugal force is limited when such flexible wire is inserted in a pipe and rotated at a high speed.

If a diameter of a main wire provided in the flexible wire is large to solve the problem, the corresponding flexibility of the flexible wire may deteriorate in proportion of the large diameter. As a result, the conventional flexible wire has limitation in removing scales in a pipe having a large diameter.

DISCLOSURE OF INVENTION

Technical Problem

To solve the problems, an object of the present invention is to provide a flexible wire for removing pipe scales, in which a rotational diameter of the wires are enlarged by a centrifugal force during a high speed rotation to remove scales smoothly.

Technical Solution

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a flexible wire for removing pipe scales includes a main wire having plural wires twisted in a spiral direction as one body, wherein the main wire has an overall straight shape; and an auxiliary wire having plural wires twisted in a spiral direction as one body, of which a diameter is substantially smaller than a diameter of the main wire, wherein the auxiliary wire is secured to the main wire and has an overall repeated S-shape.

The flexible wire for removing pipe scales may further include a securing member provided at a crossing portion between the main wire and the auxiliary wire to surroundingly secure the auxiliary wire to the main wire.

It is preferred that the securing member is a wire wound around the main wire and the auxiliary wire.

The securing member may include a U-bolt provided at a crossing portion between the main wire and the auxiliary wire to surround the main wire and the auxiliary wire at the same time; a supporting plate having a pair of holes through which both opposite ends of the U-bolt passes, wherein the supporting plate is inserted in the both opposite ends of the U-bolt through the holes; and at least one screw nut fastened to the both opposite ends of the U-bolt that passes the supporting plate, wherein the supporting plate is closely contacted with the main wire and the auxiliary wire by the screw nut.

It is preferred that a recess is formed on at least one of the main wire and the auxiliary wire so that to the auxiliary wire is securely engaged to the main wire at the crossing portion.

Advantageous Effects

The flexible wire for removing pipe scales according to the present invention has following advantageous effects.

First, the auxiliary wire having a repeated S-shape is secured to the main wire having a straight shape and thus its rotational diameter by the centrifugal force is larger, when the flexible wire is rotated at a high speed. As a result, this structure makes it easier and efficient to remove scales produced in pipes having relatively large diameter.

Furthermore, when removing pipe scales, the auxiliary wire may not separate from the main wire and there is no damage to the main and auxiliary wires, because the auxiliary is secured to the main wire by the securing members provided at each crossing portion of the main and auxiliary wires.

A still further, the securing between the main wire and the auxiliary wire may be substantially enhanced, because at least one recess is formed at which the auxiliary wire is insertedly engaged to the main wire.

A still further, the crossing interval between the main wire and the auxiliary wire may be variable based on a diameter of a pipe.

BRIEF DESCRIPTION OF THE DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings:

FIG. 1 is a front view of a conventional pipe scale removing device;

FIG. 2 is a front view illustrating a usage condition of a flexible wire provided in the conventional pipe scale removing device;

FIG. 3 is a perspective view illustrating the flexible wire of the conventional pipe scale removing device;

FIG. 4 is a perspective view illustrating a flexible wire according to the present invention FIG. 5 is a perspective view illustrating that a securing member according to a first embodiment is provided at the flexible wire for removing pipe scales according to the present invention;

FIG. 6 is a sectional view of FIG. 5;

FIG. 7 is a sectional view illustrating a usage condition of the flexible wire according to the present invention;

FIG. 8 is a perspective view illustrating that a securing member according to a second embodiment is provided at the flexible wire FIG. 9 is a sectional view of FIG. 8;

FIG. 10 is a perspective view of the flexible wire for removing pipe scales according to the present invention, which illustrates that a recess is formed at a min wire FIG. 11 is a perspective view of the flexible wire according to the present invention, which illustrates that a recess is formed at the main wire and an auxiliary wire; and FIG. 12 is an exploded perspective view of the main wire and the auxiliary wire shown in FIG. 11.

BEST MODE FOR CARRYING OUT THE INVENTION

Reference will now be made in detail to the specific embodiments of the present invention, examples of which are illustrated in the accompanying drawings. Wherever possible, the same reference numbers will be used throughout the drawings to refer to the same or like parts.

In reference to the drawings, a preferred embodiment will be explained.

As shown in FIG. 4, a flexible wire 100 for removing pipe scales includes a main wire 110 and an auxiliary wire 120. The main wire 110 is formed of plural wires that are twisted in a spiral direction as one body and it has an overall straight shape. The auxiliary wire 120 is formed of plural wires that are twisted in a spiral direction as one body with a relatively smaller diameter than a diameter of the main wire 110. Also, the auxiliary wire 120 is secured to the main wire 110 and it has an overall repeated S-shape. When the main wire 110 is rotated, the auxiliary wire 120 is rotated together.

According to the flexible wire 100 formed of the main wire 110 and the auxiliary wire 120, the main wire 110 and the auxiliary wire 120 are rotated together and thus an overall rotational diameter may be substantially larger by the centrifugal force, compared with the flexible wire without the auxiliary wire 120. As a result, the flexible wire 100 formed of the main wire 110 and the auxiliary wire 120 has an advantage of removing scales produced in a pipe having a relatively large diameter.

It is preferred that the diameter of the auxiliary wire 120 is substantially smaller than the diameter of the main wire 110, because the main wire 110 having a larger diameter can be rotated at a high speed by the centrifugal force safely, with keeping the balance in spite of the centrifugal.

As shown in FIG. 5, the auxiliary wire 120 having an overall repeated S-shape strikes an inner surface of the pipe when it is rotated at the high speed to remove scales, which results in enhancing efficiency of scale removing process.

Meanwhile, the main wire 110 and the auxiliary wire 120 may be secured each other in various ways, for example, using adhesives or welding. However, as shown in FIGS. 6 to 9, it is preferred that an auxiliary securing member 130 is provided. The securing member 130 is provided at a crossing portion between the main wire 110 and the auxiliary wire 120 and it surrounds the main wire 110 and the auxiliary wire 120 so that the auxiliary wire 120 is secured to the main wire 110.

As shown in FIGS. 6 and 7, the securing member 130 may be a wire that is wound around the main wire 110 and the auxiliary wire 120. Also, the securing member 130 is made of a material without flexibility which has substantially enough strength to securely fasten the auxiliary wire 120 to the main wire 110. Here, the number of the winding is not limited. Both opposite ends of the securing member 130 are bound up to prevent the ends from being released after surrounding the main wire 110 and the auxiliary wire 120. Binding ways of the both ends may be various including tying up the both ends, using an auxiliary pressing member, uniting the ends by bonding, or the like. If the securing member 130 is a wire, both ends of the securing member 130 may be twisted predetermined times as shown in the drawings.

On the other hand, as shown in FIGS. 8 and 9, the securing member 130 includes a U-bolt 141, a supporting plate 142 and a screw nut 143. The U-bolt 141 is provided at the crossing portion between the main wire 110 and the auxiliary wire 120 to surround the main wire 110 and the auxiliary wire 120 at the same time. The supporting plate 142 has a pair of holes through which both opposite ends of the U-bolt 141 pass and the U-bolt 141 is insertedly fastened to the supporting plate 142. The screw nuts 143 are fastened to the U-bolt 141 that has passed through the supporting plate 142, so that the supporting plate 142 is closely contacted with the main wire 110 and the auxiliary wire 120.

Thus, when the U-bolt 141 is positioned at the crossing portion between the main wire 110 and the auxiliary wire 120, the supporting plate 142 is inserted in the both opposite ends of the U-bolt 141 and the screw nut 143 is fastened to the both opposite ends of the U-bolt 141. Hence, the supporting plate 142 is close to the main wire 110 and the auxiliary wire 120 by the screw nut 143. As a result, the auxiliary wire 120 may be secured to the main wire 110.

As shown in FIGS. 10 to 12, it is preferred that a recess 150 is provided on at least one of the main wire 110 and the auxiliary wire 120. The main wire 110 and the auxiliary wire 120 are crossed at the recesses 150, being secured at the recess 150. FIG. 10 shows that the recesses are formed at the main wire 110. FIGS. 11 and 12 show that the recesses 150 are formed at both the main wire 110 and the auxiliary wire 120, respectively.

If the recesses 150 are formed on at least one of the main wire 110 and the auxiliary wire 120 at the crossing portion, the main wire 110 and the auxiliary wire 120 are fastened each other at the crossing portion, which can enhance securing efficiency between the main wire 110 and the auxiliary wire 120. Still more, it is easy and simple to install the auxiliary wire 120 along the recesses 150 formed at the main wire 110 at a predetermined distance uniformly.

On the other hand, the crossing interval between the main wire 110 and the auxiliary wire 120 may be variable based on the diameter of the pipe. As a result, additional recesses 150 may be further formed at the main and auxiliary wires 110 and 120 to change the crossing interval. In this case, the distance between the recesses 150 may be variable.

The flexible wire according to the present invention may be used at a predetermined portion that extends from a guide pipe provided in the pipe scale removing device.

Furthermore, as needed, some part of the pipe scale removing device may be structurally changeable to apply the flexible wire thereto.

It will be apparent to those skilled in the art that various modifications and variations can be made in the present invention without departing from the spirit or scope of the inventions. Thus, it is intended that the present invention cover the modifications and variations of this invention provided they come within the scope of the appended claims and their equivalents.

INDUSTRIAL APPLICABILITY

The flexible wire for removing pipe scales according to the present invention has an industrial applicability.

First, the auxiliary wire having a repeated S-shape is secured to the main wire having a straight shape and thus its rotational diameter by the centrifugal force is larger, when the flexible wire is rotated at a high speed. As a result, this structure makes it easier and efficient to remove scales produced in pipes having relatively large diameter.

Furthermore, when removing pipe scales, the auxiliary wire may not separate from the main wire and there is no damage to the main and auxiliary wires, because the auxiliary is secured to the main wire by the securing members provided at each crossing portion of the main and auxiliary wires.

A still further, the securing between the main wire and the auxiliary wire may be substantially enhanced, because at least one recess is formed at which the auxiliary wire is insertedly engaged to the main wire.

A still further, the crossing interval between the main wire and the auxiliary wire may be variable based on a diameter of a pipe.

The invention claimed is:

1. A flexible wire for removing pipe scales comprising:

a main wire having plural wires twisted in a spiral direction as one body, wherein the main wire has an overall straight shape, the main wire forming a central axis of rotation; and an auxiliary wire having plural wires twisted in a spiral direction as one body, of which a diameter is substantially smaller than a diameter of the main wire, wherein the auxiliary wire is secured to the main wire and has an overall repeated S-shape curving along a plane parallel to a longitudinal axial plane of the main wire.

2. The flexible wire for removing pipe scales as claimed in claim 1, further comprising a securing member provided at a crossing portion between the main wire and the auxiliary wire to surroundingly secure the auxiliary wire to the main wire.

3. The flexible wire for removing pipe scales as claimed in claim 1, wherein a securing member is a wire wound around the main wire and the auxiliary wire.

4. The flexible wire for removing pipe scales as claimed in claim 2, wherein the securing member comprises, a U-bolt provided at a crossing portion between the main wire and the auxiliary wire to surround the main wire and the auxiliary wire at the same time;

a supporting plate having a pair of holes through which both opposite ends of the U-bolt passes, wherein the supporting plate is inserted in the both opposite ends of the U-bolt through the holes; and at least one screw nut fastened to the both opposite ends of the U-bolt that passes the supporting plate, wherein the supporting plate is closely contacted with the main wire and the auxiliary wire by the screw nut.

5. The flexible wire for removing pipe scales as claimed in one of claims 1 to 4, further comprising a recess formed where the main wire and auxiliary cross at a crossing portion, on at least one of the main wire and the auxiliary wire so that the auxiliary wire is securely engaged to the main wire at the crossing portion.

* * * * *